United States Patent [19]

Grinberg et al.

[11] Patent Number: 4,747,069

[45] Date of Patent: May 24, 1988

[54] PROGRAMMABLE MULTISTAGE LENSLESS OPTICAL DATA PROCESSING SYSTEM

[75] Inventors: Jan Grinberg, Los Angeles; Bernard H. Soffer, Pacific Palisades, both of Calif.

[73] Assignee: Hughes Aircraft Company, Los Angeles, Calif.

[21] Appl. No.: 70,083

[22] Filed: Jul. 2, 1987

Related U.S. Application Data

[63] Continuation of Ser. No. 713,064, Mar. 18, 1985, abandoned.

[51] Int. Cl.[4] ..... G06G 9/00

[52] U.S. Cl. ..... 364/807; 364/845; 364/841

[58] Field of Search ..... 364/807, 819, 820, 822, 364/837, 841, 845, 713, 602, 604; 350/96.1, 96.11, 96.14, 96.16, 162.12, 162.13, 162.14, 358

[56] References Cited

U.S. PATENT DOCUMENTS

| | | | |
|---|---|---|---|
| 3,989,355 | 11/1976 | Wilmer | 350/160 LC |
| 4,225,938 | 9/1980 | Turpin | 364/822 |
| 4,344,675 | 8/1982 | Yao | 350/358 |
| 4,440,472 | 4/1984 | Cohen | 350/162.12 |
| 4,544,229 | 10/1985 | Verber | 350/96.14 |
| 4,544,230 | 10/1985 | Caulfield | 350/96.14 |
| 4,556,950 | 12/1985 | Tai et al. | 364/827 |
| 4,567,569 | 1/1986 | Caulfield et al. | 364/845 |
| 4,569,033 | 2/1986 | Collins et al. | 364/845 |
| 4,579,417 | 4/1986 | Ih | 350/96.11 |
| 4,588,255 | 5/1986 | Tur et al. | 350/96.16 |
| 4,595,994 | 6/1986 | Verber et al. | 364/841 |

FOREIGN PATENT DOCUMENTS

| | | |
|---|---|---|
| 3121436 | 4/1982 | Fed. Rep. of Germany . |
| 3218244 | 11/1983 | Fed. Rep. of Germany . |

OTHER PUBLICATIONS

Applied Optics, vol. 23, No. 6, Mar. 1984, New York; Verber et al.: "Pipeline Polynomial Processors Implemented with Integrated Optical Components", pp. 817–821.

Patents Abstracts of Japan, vol. 7, No. 51, (p-179) (1196), Feb. 26, 1983, & JP, A, 57198434, (Yokogawa).

*Primary Examiner*—Joseph F. Ruggiero
*Assistant Examiner*—Charles B. Meyer
*Attorney, Agent, or Firm*—V. D. Duraiswamy; A. W. Karambelas; V. G. Laslo

[57] ABSTRACT

An optical data processing system employing a programmable optical data processor for processing an optical data beam comprising a plurality of zero, one and two-dimensional modulators for spatially modulating the optical data beam, the modulators being interconnected such that lenses are not necessary to accomplish the focusless transfer of the optical data beam between the modulators. The plurality of modulators are controlled so as to permit the programmable processing of the optical data beam. The optical data processor realized is physically solid and compact and is readily capable of performing a wide variety of optical computations.

24 Claims, 3 Drawing Sheets

PROGRAMMABLE MULTISTAGE LENSLESS OPTICAL DATA PROCESSING SYSTEM

This application is a continuation of application Ser. No. 06/713,064, filed Mar. 18, 1985, now abandoned.

CROSS-REFERENCE TO RELATED APPLICATIONS (a) Pending U.S. patent application Ser. No. 883,437, filed July 14, 1986 entitled "Method of Performing Matrix by Matrix Multiplication", and assigned to Hughes Aircraft Company, the assignee of the present invention.

(b) Pending U.S. patent application, Ser. No. 713,063, filed Mar. 18, 1985, entitled "Programmable Methods of Performing Complex Optical Computations Using Data Processing System", and assigned to Hughes Aircraft Company, the assignee of the present invention.

FIELD OF THE INVENTION

The present invention generally relates to optical computing and data processing systems and, in particular, to a multistage lensless optical processor that is electrically programmable to perform a wide variety of complex computations on optical data.

BACKGROUND OF THE INVENTION

Optical processing of vector and matrix data is known for its potential high effective computational performance capabilities and its natural adaptability to computationally intensive image processing. Images, or other spatially relatable data, may be treated as matrices composed of rastor or vector scans of data elements that, at their real or effective resolution limit, are generally referred to as pixels. An ordinary image is typified by an analog picture frame taken as a cross section of an optical beam formed of a continuous series of such images. Each analog image frame typically contains an effectively continuous spatially distributed array of pixel data. Alternately, discrete matrix data may be impressed onto a data beam by spatially modulating the cross section of a data beam in terms of, for example, either its localized intensity or polarization vector.

In any case, optical processing is of great potential value due to its fundamentally parallel processing nature. The parallelism, of course, arises due to the processing of complete images at a time. As each pixel is a separate datum, the volume of data processed in parallel is generally equivalent to the effective resolution of the image. Additionally, optical processing has the virtue of processing data in the same format that it is conventionally obtained. Typically, and for such applications as image enhancement and recognition, the data to be processed is generally obtained as a single image or as a rastor scan of an image frame. Potentially then, an optical processor may receive data directly without conventional or other intermediate processing. Since the informative value of image data increases with the effective resolution of the image and the number of images considered, the particular and unique attributes of optical processing become quite desirable.

Conventionally, optical processing is performed by projecting an image to be processed through a selected spatial mask onto an appropriate optical detector. The mask itself is, in its simplest form, only an image fixed in a film. Even as such, relatively complex optical processing computations may be performed.

Optical processor projection systems, however, generally require a variety of highly specialized components including arc lamps as illuminating point sources, collimating and focusing lenses, polarizing and polarization rotation plates, beam splitters, and mirrors. In addition to their respective fabrication complexities, these components must be assembled and maintained, often in critical alignment, spatially separated from one another. Consequently, the optical processing apparatus is large and bulky, sensitive to its environment, particularly in terms of vibration and contamination, and specifically limited to performing one or only a few quite closely related optical processing calculations.

In addition to photographic films, a temporally variable mask for optical processors has been realized as a two-dimensional spatial light modulator (SLM) that, through electronic activation, effects selective alteration of the spatially distributed data impressed on a data beam by the mask. A typical two-dimensional (2D) SLM is realized through the use of a photo-electrically activated reflective type liquid crystal light valve which may be coupled to a cathode ray tube. Aside from the inefficiency of the dual serial electric-to-optical conversion of the image, such 2D SLM devices perform well for many applications within specific limits. Unfortunately, these performance limits include a relatively slow liquid crystal light valve response time of typically greater than 10 milliseconds. This naturally directly impacts the high speed processing capability of an optical processor. Additionally, the use of this type of mask requires further focusing, beam splitting and support components with the end result being a mechanically complex optical processor.

Two-dimensional SLM masks have also been realized in the form of a solid electro-optic element activated by a two-dimensional spatially distributed array of electrodes. The modulating image is effectively formed by separately establishing the voltage potential of each of the electrodes at an analog corresponding to their respective intended data values. As may be well expected, the complexity level of such a two-dimensional SLM increases proportionally to the square of its pixel resolution (N). Complexity further increases where the $N^2$ electrodes must be independently addressable to permit operation at data rates sufficiently high to be of utility in optical data processing (for instance, for $N=1000$, one has to address 1 million electrodes). The current level of fabrication technology, unfortunately, stands as a practical barrier to the reproducible fabrication of even moderately high resolution independent pixel addressable two-dimensional SLM devices. Alternately using a low effective resolution mask would directly impact the high speed data processing capabilities of the optical processor.

SUMMARY OF THE INVENTION

A purpose for the present invention is, therefore, to provide an optical data processor that can be flexibly and reliably operated to perform a wide variety of complex data processing functions while avoiding or overcoming most, if not all, of the deficiencies of the prior art.

This is attained in the present invention by providing an apparatus for processing an optical data beam comprising a plurality of modulators for spatially modulating the optical data beam, means for the lensless interconnection of each of the modulators to provide for the lensless transfer of the optical data beam between the modulators, and means for controlling the plurality of modulators so as to permit the programmable processing of the optical data beam.

Thus, an advantage of the present invention is that it does not require the use of focusing lenses and other associated components and, consequently, it occupies only very small volume and requires no post construction realignment to insure proper and accurate operation.

Another advantage of the present invention is that it can be configured to include a variety of functionally different spatial light modulators.

A further advantage of the present invention is that it may be configured to optimally perform a variety of different optical data processing functions.

Still another advantage of the present invention is that it can be dynamically and electrically reconfigured as needed to perform significantly different optical data processing functions.

Yet another advantage of the present invention is that its construction yields a compact, solid, rigid structure that, while even including all components necessary to provide a maximum flexibility operation configuration, requires only a relatively minimum component-type structure as compared to prior art systems.

A still further advantage of the present invention is that it may utilize solid state or liquid crystal electro-optic devices.

Yet still another advantage of the present invention is that it requires only one integrally coupled incoherent light source from which to operate.

BRIEF DESCRIPTION OF THE DRAWINGS

Other attendant advantages of the present invention will become apparent and readily appreciated as the same becomes better understood by reference to the following detailed description when considered in connection with the accompanying drawings in which like reference numerals designate like parts throughout the figures, and wherein.

DETAILED DESCRIPTION OF THE INVENTION

Figure 1:
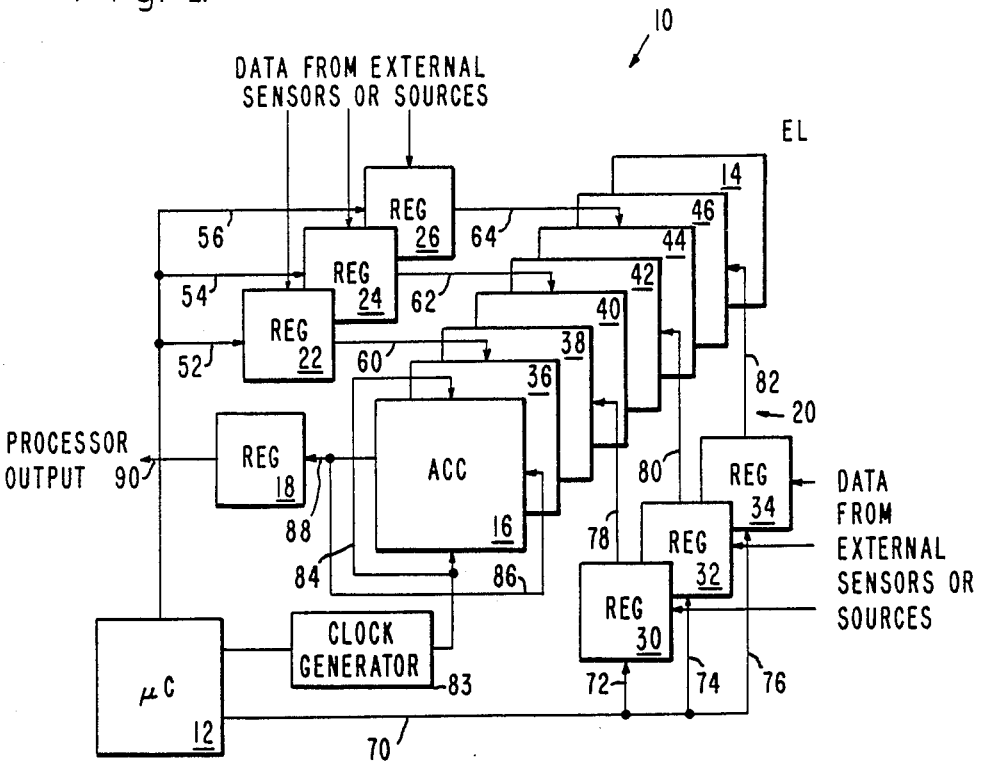
FIG. 1 is a perspective block diagram of a preferred optical data processing system in accordance with the present invention.

The preferred system embodiment of the present invention, generally indicated by the reference numeral 10, is shown in FIG. 1. In particular, the preferred multistage optical data processor (ODP), generally indicated by the reference numeral 20, is operatively supported by the microcontroller 12 and interface registers 18, 22, 24, 30, 32 and 34. While the preferred structure of the ODP 20 will be described in greater detail below, the principal operative components of the ODP 20 are shown in FIG. 1 as including a flat panel light source 14, matrix array accumulator 16 and a plurality of spatial light modulators (SLMs) 36, 38, 40, 42, 44 and 46. Preferably, the light source 14, accumulator 16 and the SLMs 36, 38, 40, 42, 44, 46 are provided in closely adjacent parallel planes with respect to one another such that a relatively uniform beam provided by the light source 14 travels through each of the spatial light modulators in succession and is ultimately received by the accumulator 16. The light beam is effectively used as a data transport mechanism acquiring data provided by each of the spatial light modulators that is subsequently delivered to the accumulator 16. The operation of each of the spatial light modulators can be explained in terms of their spatial transmissivity variation with respect to corresponding spatially distributed activating voltage potentials. To a first approximation at least, the transmissivity of a spatial light modulator is directly proportional to the applied voltage potential. Thus, the combined transmissivity ($T_0$) of two serially coupled spatial light modulators is proportional to the product of the respective transmissivities of the spatial light modulators. The combined transmissivity T0 can thus be written as:

$$T_0 = T_1 \times T_2 \quad (1)$$

$$T_0 = \alpha\beta V_1 V_2 \quad (2)$$

where $V_1$ and $V_2$ are the respectively applied voltage potentials, and $\alpha$ and $\beta$ are the transmissivity to applied voltage coefficients for the respective spatial light modulators. Where an extended series of spatial light modulators are serially coupled, in accordance with the present invention, the combined transmissivity $T_0$ of the multistage spatial light modulator stack is proportional to the product of the respective transmissivities of the individual spatial light modulators. A light beam provided by the flat panel 14 can thus be directed to acquire spatially distributed data corresponding to the spatially distributed relative transmissivities of each of the spatial light modulators 36, 38, 40, 42, 44 and 46.

In accordance with the preferred embodiment of the present invention, spatially relatable data is provided to the spatial light modulators 36, 38, 40, 42, 44 and 46 via the interface registers 22, 24, 26, 30, 32 and 34. These registers preferably operate as high speed digital data storage registers, buffers and digital-to-analog data converters. As will be discussed in greater detail below, the stack of spatial light modulators preferably includes a plurality of one-dimensional spatial light modulators and one or more two-dimensional spatial light modulators. As shown in FIG. 1, one-dimensional spatial light modulators 36, 38, 40, 42 and 44 are coupled to respective registers 22, 30, 24, 32 and 26 via interface data lines 60, 78, 62, 80 and 64. A two-dimensional spatial light modulator 46 receives data from register 34 via the interface data line 82.

The interface registers 22, 24, 26, 30, 32 and 34 in turn preferably receive data in a parallel form provided by external sensors. The microcontroller 12 via the processor control buses 50, 70 provide the control signals. While the processor control buses 50, 70 are shown as separate and respectively connected to the registers by the register control lines 52, 54, 56, 72, 74 and 76, the interface registers may alternately be coupled via control multiplexers to a single, common control bus driven by the microcontroller 12. In either case, however, it is essential only that the microcontroller 12 possess sufficient control over the registers 22, 24, 26, 30, 32 and 34 to selectively provide its predetermined data thereto.

The optical data processor system 10 is completed with the provision of the output register 18 coupled between the accumulator 16 and the processor output. The accumulator 16 itself is a matrix array photosensitive device capable of converting incident light intensity into a corresponding voltage potential representative of the data beam at an array resolution at least matching that of the spatial light modulators 36, 38, 40, 42, 44 and 46. As will be described in greater detail below, the accumulator 16 accumulates light beam data that can then be shifted by means of a clock signal supplied by a clock generator 83 to the data output register 18 via the output interface bus 88. The accumulator 16 also includes circular shift bus 86 and lateral shift bus 84 to permit a wide variety of shift and sum operations to be performed within the accumulator 16 during the operation of the optical data processor 20.

The data output register 18 is preferably a high speed analog-to-digital converter, shift register and buffer that channels the shifted output data from the accumulator 16 to the processor output via the processor data output bus 90.

As should be well apparent from the foregoing, the microcontroller 12 possesses full control over the optical data processor 20. Any desired data can be provided to any specific combination of spatial light modulators to implement a desired data processing algorithm, thus permitting the programmable processing of data. Of particular facility is that only those spatial light modulators required for the performance of any particular optical data processing algorithm need be actively utilized in the optical data processor 20 in accordance with the present invention. Spatial light modulators within the optical data processor 20 may be provided with appropriate data via their respective data registers to uniformly maintain the spatial light modulators at their maximum transmissivity. Consequently, selected spatial light modulators may be effectively removed from the optical data processor by their appropriate data programming. Thus, the optical data processing system 10 provides an extremely flexible environment for the performance of optical data processing computations.

Figure 2:
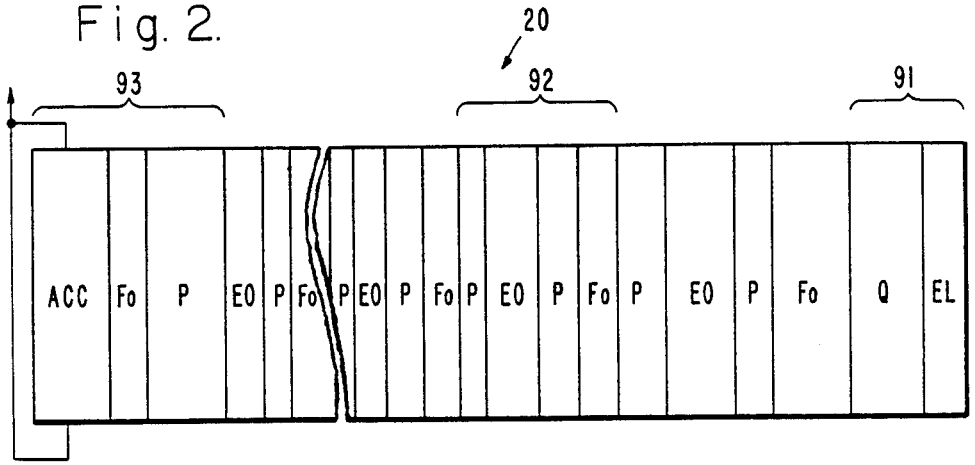
FIG. 2 is a side view of a preferred generic embodiment of an optical data processor constructed in accordance with the present invention.

The structure of an exemplary optical data processor 20 fabricated in accordance with the preferred embodiment of the present invention is shown in FIG. 2. The embodiment shown is exemplary as including substantially all of the principal components that may be incorporated into any preferred embodiment of the present invention.

The components of the optical data processor may be functionally grouped as parts of a light source 91, SLM stage 92 and data beam receiver 93. The light source 91 essentially includes the flat panel light source (El) 14 and, optionally, a light beam buffer component (Q) 94. The flat panel light source 14 is preferably an electroluminescent display panel or, alternately, a gas plasma display panel or LED or LED array or laser diode or laser diode array. The buffer component 94 is preferably utilized to grade the light produced by the flat panel display panel into a spatially uniform optical beam. Where a gas plasma display is utilized, the buffer component 94 may further function to insulate the remainder of the optical data processor 20 from any heat generated by the plasma display 14. In either case, the buffer component 94 is preferably an optical glass plate having a thickness of approximately 0.25 inch.

The bulk of the optical data processor 20 is formed by a serial stack of SLM stages, of which SLM stage 92 is representative. While each stage is preferably identical in terms of their component composition, the SLM of each is the only essential component. Preferably, the SLM is a rigid structure requiring no additional support. In such embodiments, the SLMs may be placed immediately adjacent one another, separated only by a thin insulating optically transparent layer, yielding an optimally compact multistage stack of spatial light modulators. However, where the spatial light modulators are, for example, of a material possessing insufficient structural strength to provide for their own support, the stage 92 preferably further includes a supporting fiber optic plate (Fo) 102. The fibers of the fiber optic plate 102 are, of course, aligned with their cylindrical axes parallel the major axis of the optical data processor 20. Also, in such embodiments utilizing a fiber optic plate 102 and where the significant operation of the spatial light modulator is accomplished through the polarization modulation of the light beam, a polarizer (P) 64 is preferably interposed between the SLM 44 and fiber optic plate 102. The polarizer 64 further permits the utilization of an unpolarized optical data beam source 14 in local polarization vector data representation embodiments of the present invention. If the principle of operation of the spatial light modulation is light absorption (instead of polarization rotation), then there is no need for the polarizers.

The data beam receiver 93 essentially includes an accumulator component (ACC) 16. The accumulator 16 is preferably a solid state matrix array of optical detectors. In particular, the optical detector array is preferably a two-dimensional shift register array of conventional charge coupled devices (CCDs) provided at an array density equivalent to the effective resolution of the optical data processor 20. The use of a CCD array is preferred both for its charge accumulation, i.e., data summing, capability as well as for the ease of fabricating CCD shift register circuitry that can be directly controlled by the microcontroller 12. Further, the use of the CCD array permits substantial flexibility in the operation of the accumulator 16 by permitting data shifted out of the accumulator 16 and onto the data return bus 88 to be cycled back into the accumulator 16 via the circular shift data bus 86. Additionally, the accumulator 16 possesses the desirable flexibility through the use of adjacent register propagation path interconnections to permit lateral cycling of the data contained therein via the lateral shift data bus 84 generally as indicated in FIG. 1. Consequently, the accumulator 16 can be effectively utilized in the execution of quite complex optical data processing algorithms involving shift and sum operations under the direct control of the microcontroller 12.

The data beam receiver 93 may optionally include a fiber optic plate (FO) 122 as may be desirable in interconnecting the accumulator 16 with the SLM 44 of the last stage 92 of the optical data processor 20.

Figure 3:
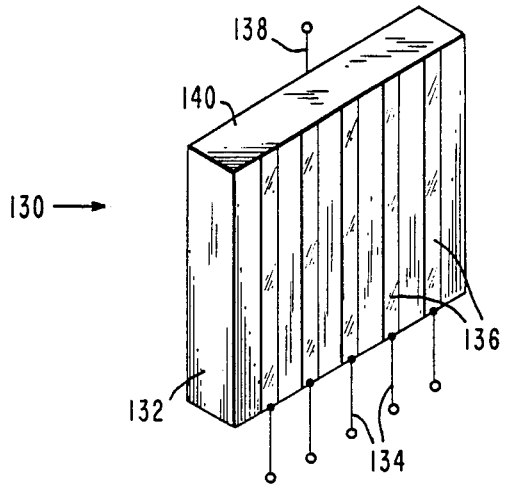
FIG. 3 is a perspective detail of an electro-optical optical spatial light, modulator utilized in the present invention.
Figure 4:
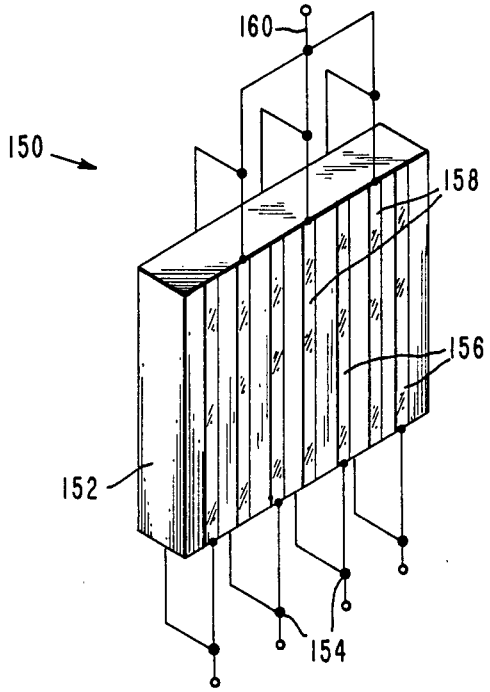
FIG. 4 is a perspective view of another electro-optical spatial light modulator utilized in the present invention.
Figure 5A:
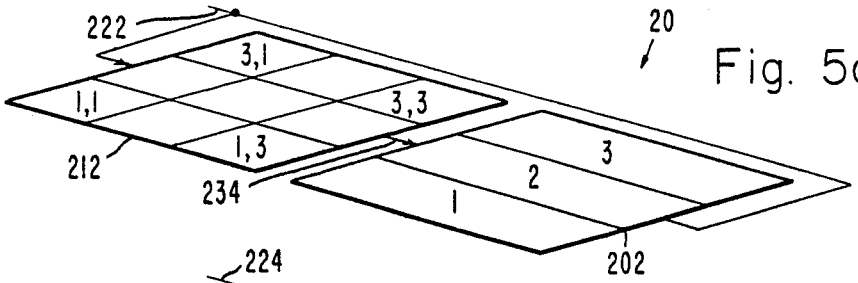
FIGS. 5*a* through 5*f* are exploded perspective representations of different planes of a preferred embodiment of the present invention for illustrating its preferred methods of operation.
Figure 5B:
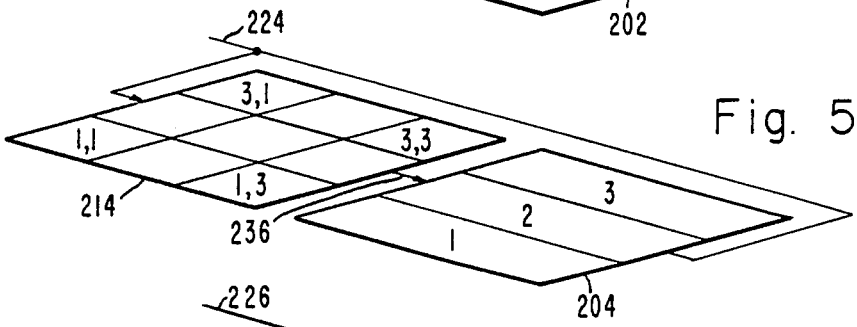
Figure 5C:
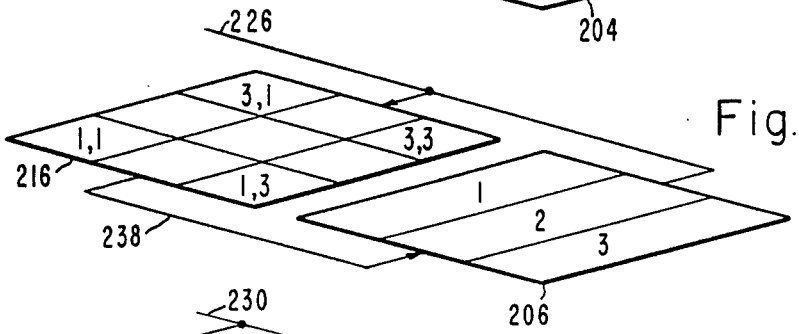
Figure 5D:
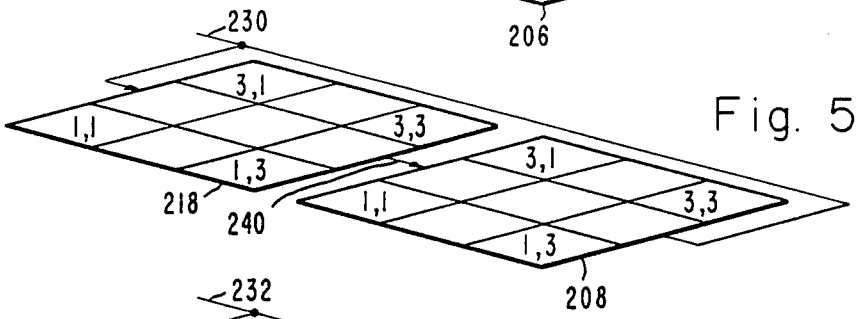
Figure 5E:
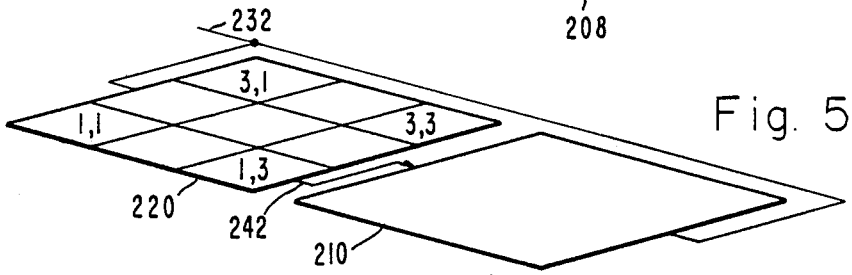
Figure 5F:
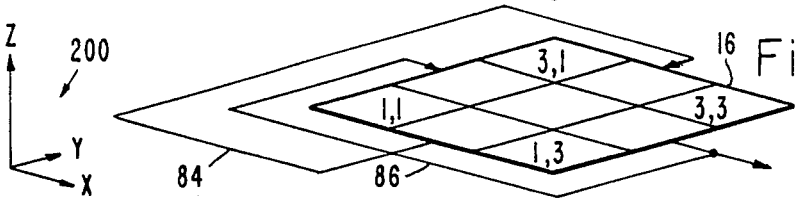

The preferred embodiments of the one-dimensional spatial light modulators, in accordance with the present invention, are shown in FIGS. 3 and 4. The spatial light modulator 130 shown in FIG. 3 includes an electro-optic element 132 preferably having two major parallel opposing surfaces upon which stripe electrodes 136 and potential reference plane 140 are provided respectively.

The electro-optic element 132 may be a transmission mode liquid crystal light valve though preferably it is a solid state electro-optic material, such as $KD_2PO_4$ or $BaTiO_3$. This latter material polarization modulates light locally in proportion to the longitudinal and transverse voltage potential applied across that portion of the material that the light passes through. This material characteristically possesses sufficient structural strength to be adequately self-supporting for purposes of the present invention when utilized as electro-optic elements 132 provided at a thickness of approximately 5 to 10 mil for a major surface area of approximately one square inch.

As the active regions of the electro-optic element 132 necessarily lie between each of the stripe electrodes 136 and the reference plane electrode 140, the electrodes 136, 140 are preferably of a highly conductive transparent material such as indium tin oxide. Contact to the electrodes 136, 140 is preferably accomplished through the use of separate electrode leads 134, 138, respectively, that are attached using conventional wire bonding or solder bump interconnect technology.

A variation of the spatial light modulator 130 provides a zero dimensional, or uniform, spatial light modulator that is of particular utility in the present invention. By commonly connecting the stripe electrode leads 134, the transmissivity of the electro-optic material 132 will be uniformly modulated at all pixel locations. Alternately, a single electrode covering the entire major surface of the electro-optic material 132 may be substituted for the stripe electrodes 136.

FIG. 4 illustrates an alternate one-dimensional spatial light modulator consistent with the present invention. This spatial light modulator significantly differs from that of FIG. 3 by the relative placement of the signal 156 and potential reference 158 electrodes on the two major surfaces of the electro-optic element 152. On each major surface, a reference potential electrode 158 is interposed between pairs of the signal electrodes 156 to form an interdigitated electrode structure that is essentially identical on both major surfaces of the electro-optic element 152. The active portions of the electro-optic element 152 lie between each of the signal electrodes 156 and their surface neighboring reference potential electrodes 158. Thus, the achievable electro-optic effect is enhanced through the utilization of both surfaces of the electro-optic element 152. Further, as the active portions of the electro-optic element 152 are not shadowed by the signal electrodes 156, all of the electrodes 156, 158 may be of an opaque conductive material, such as aluminum, that may be further advantageously utilized to effectively mask the active regions of the electro-optic element 152. That is, the electrodes 156, 158 may be utilized to block the respective pixel edge portions of the data beam as they diverge while passing through the electro-optic element 152.

Similar to the spatial light modulators 130 of FIG. 3, the electro-optic element 152 may be either a liquid crystal light valve or a solid state electro-optic material. For reasons of faster electro-optic response time, greater structural strength, and ease of fabrication, transverse field polarization modulation electro-optic materials, such as represented by $LiNbO_3$, $LiTaO_3$, $BaTiO_3$, $Sr_xBa_{(1-x)}NbO_3$ and PLZT are preferred. These materials are believed to possess the generally equivalent structural strength characteristics as the polarization modulation material $KD_2PO_4$ described above. Electrode leads to the electrode strips 156, 158 are again preferably attached using conventional wire bonding or solder bump interconnect technology.

The versatility of the present invention in performing a wide variety of complex data processing functions through the use of unique algorithms is best illustrated with reference to FIGS. 5*a* through 5*f*. In order to facilitate the description of the operation of the present invention, a preferred embodiment of the optical data processor 20 is functionally illustrated FIGS. 5*a*, 5*b*, 5*c*, 5*d* 5*e* and 5*f*, respectively, as a series of planes A, B, C, D, E and F, each plane parallel to the X and Y axis and distributed along the Z axis of the coordinate system 200. For the sake of simplicity of description, the optical data processor 20 is shown as having an effective resolution of three by three pixels. As illustrated planes A, B and C contain registers 212, 214, 216 interconnected by buses 234, 236, 238 to one-dimensional spatial light modulators 202, 204, 206 and to the microcontroller 12 by buses 222, 224, 226, respectively. The registers 212, 214, 216 each preferably includes a three by three pixel buffer array. The A and B plane one-dimensional spatial light modulators 202, 204 provide for the modulation of three pixel rows (parallel to the X axis). The spatial light modulator 206 of plane C is distinguished as providing for the modulation of three pixel columns (parallel to the Y axis).

A two-dimensional spatial light modulator 208 driven by register 218 via bus 240 is provided in plane D with both being interconnected with the microcontroller 12 by the bus 230. Since, as will be demonstrated below, the operation of the two-dimensional spatial light modulator is effectively static with respect to the other planes of the optical data processor, the necessity of high speed independent addressing of the array electrodes is substantially obviated. Rather, simpler shift register mode propagation of data may be utilized in the operation of the two-dimensional spatial modulator 208. Consequently, the construction constraints and complexity limitations in the reliable fabrication of high resolution matrix spatial light modulators are greatly eased for purposes of the present invention.

Plane E includes the three by three pixel register 220 that is interconnected with a uniform, zero-dimensional spatial light modulator 210 via the single pixel bus 242 and both with the microcontroller 12 via the bus 232.

Finally, a matrix array accumulator 16 is provided in plane F. As above, circular 86 and lateral 84 shift buses are provided to permit flexible sum and shifting operations to be performed under the control of the microcontroller 12.

The flexibility and versatility of the present invention is illustrated by its capacity to perform the representative algorithms described below. Each algorithm functions to process data representable as an optical image. While the functions realized by the generation of the resultant optical images may be well known, their respective algorithmic performance is unique and particular to the present invention.

Function 1

A two-dimensional Fourier transform of two-dimensional data, appropriate for two-dimensional spectral analysis, is performed by:

Initialize 1. load the two-dimensional data into the register 216 of plane C, apply the row 3 data to the respective columns of the SLM 206;

2. load the Fourier transform coefficients for the first dimension analysis into the register 212 of plane A, apply the column 3 data to the respective rows of the SLM 202;
3. load all other registers 214, 218, 220 of the optical data processor 20 with uniform data corresponding to maximum spatial light modulator 204, 208, 210 transmissivity;
4. clear the accumulator 16 of plane F;

Process 5. sum the current optical pixel products of the optical data beam with the corresponding previous pixel product sums;
6. column shift the data present in the register 212 by one column in a given (for example, right) direction, apply the new column 3 data to the respective rows of the SLM 202;
7. row shift the data present in the register 216 by one row in a given (for example, up) direction, apply the new row 3 data to the respective columns of the SLM 206;
8. repeat steps 5 through 7 for each row of the two-dimensional data stored in register 216 of plane C;
9. transfer the matrix, array data summed into the accumulator 16 of plane F into the register 216 of plane C, apply the row 3 data to the respective columns of SLM 206;
10. load the Fourier transform coefficients for the second dimension analysis into the register 212 of plane A, apply the column 3 data to the respective rows of the SLM 202;
11. repeat steps 5 through 7 for each row of the two-dimensional data stored in register 216 of plane C; and Provide resultant image 12. transfer the matrix array data summed into the accumulator 16 of plane F to the microcontroller 12.

Function 2

A two-dimensional cross correlation of two-dimensional data, appropriate for image recognition, is performed by:

Initialize 1. load the two-dimensional data into the register 220 of plane E, apply the data from a given single pixel corresponding location (for example, 1,3) and apply to the uniform electrode of the SLM 210;
2. load the two-dimensional correlation mask data into the register 218 of plane D, apply the data to the respective pixel locations of the SLM 208;
3. load all other registers 212, 214, 216 with uniform data corresponding to maximum spatial light modulator 202, 204, 206 transmissivity;
4. clear the accumulator 16 of plane F;

Process 5. sum the current optical pixel products of the optical data beam with the corresponding previous pixel product sums;
6. column shift the data present in the register 220 by one column in a given direction (for example, right), apply the new data from the given single pixel corresponding location to the SLM 210;
7. column shift the sums present in the accumulator 16 by one column in the same direction as register 220 is shifted;
8. repeat steps 5 through 7 for each column of data stored in the register 220 of plane E;
9. row shift the data present in the register 220 by one row in a given direction (for example, up), apply the new data from the given pixel corresponding location to the SLM 210;
10. row shift the sums present in the accumulator 16 by one row in the same direction as register 220 is shifted;
11. repeat steps 8 through 10 for each row of data stored in the register 220 of plane E; and Provide resultant image 12. transfer the matrix array data summed into the accumulator 16 of plane F to the microcontroller 12.

Function 3

A one-dimensional sliding window cross ambiguity function calculation with respect to one-dimensional data is performed by:

Initialize 1. load the real part of the Fourier transform coefficient matrix into the register 212 of plane A, apply the column 3 data to the respective rows of the SLM 202;
2. load each row of the register 216 of plane C with the identical fixed length, one-dimensional reference data template, apply the row 3 data to the respective columns of the SLM 206;
3. load each row of the register 214 of plane B with an identical portion of the continuously running one-dimensional input data, apply the column 3 data to the respective rows of the SLM 204;
4. load all other registers 218, 220 of the optical data processor 20 with uniform data corresponding to maximum spatial light modulator 208, 210 transmissivity;
5. clear the accumulator 16 of plane F;

Process 6. sum the current optical pixel products of the optical data beam with the corresponding previous pixel product sums;
7. column shift the data present in the register 212 of plane A by one column toward column 3, apply the new data present in column 3 to the respective rows of the SLM 202, recirculate the column data shifted out of column 3 and store in column 1 of the register 212;
8. column shift the data present in the register 214 of plane B by one column toward column 3, load each pixel location of column 1 of register 214 with the next sequential input datum, apply the new data present in column 3 to the respective rows of the SLM 204;
9. column shift the sums present in the accumulator 16 by one column toward column 3, clear the pixel corresponding sums of column 1 of the accumulator 16, retain external to the optical data processor 20 the data shifted out of column 3 as to last column of the most recent sliding window cross ambiguity function matrix calculated for the corresponding portion of the input data stream; and 10. repeat steps 6 through 9 for each datum taken from the input data stream as buffered through the register 214 of plane B updating the most recent sliding window across ambiguity function matrix with each column of data shifted out of the accumulator 16.

Thus, an electrically programmable optical data processor that can be dynamically reconfigured to perform a wide variety of complex optical computations has been described.

In view of the above teachings, persons of skill in the optical arts will readily appreciate that many modifications and variations of the present invention are possible and contemplated. Accordingly, the present invention may be practiced other than as specifically described above without departing from the nature and scope of the present invention as set forth in the appended claims.

What is claimed is:

1. Apparatus for processing an optical data beam to selectively perform optical computation from a plurality of performable optical computations, comprising:

(a) modulator means including a plurality of modulator planes for spatially modulating said optical data beam, (b) means for the lensless interconnection of respective ones of said plurality of modulator planes so as to provide for the focusless transfer of said optical data beam between respective said plurality of modulator planes; and (c) means for providing data to selected modulator planes, said data being provided in a manner dependent on the desired optical computation, so as to permit the programmable processing of said desired optical computation.

2. The apparatus of claim 1 wherein said plurality of modulator planes comprises at least first, second and third spatial light modulator planes, at least said first and second spatial light modulator planes each including means for the one-dimensional modulation of said optical data beam, said first spatial light modulator plane being crossed with respect to said second spatial light modulator plane, both crossed with respect to said optical data beam.

3. The apparatus of claim 2 wherein said plurality of modulator planes further comprises at least one spatial light modulator plane including a two-dimensional array of pixel means for the two-dimensional modulation of said optical data beam.

4. The apparatus of claim 3 further comprising:

(a) source means for providing said optical data beam; and (b) receiver means for receiving said optical data beam, said source means and said receiver means being coupled by said lensless interconnection means to respective ones of said modulator planes, said receiver means including accumulator means for accumulating said optical data beam data and shifting and summing said data so as to permit execution of shift-and-sum optical operations.

5. The apparatus of claim 4 wherein said lensless interconnection means provides for the physical, substantially rigid interconnection of said plurality of modular planes so that said apparatus is essentially solid.

6. The apparatus of claim 5 wherein said source means provides incoherent light.

7. The apparatus of claim 6 wherein said lensless interconnection means comprises fiber optic means for the lensless guided transport of said optical data beam.

8. The apparatus of claim 7 wherein each of said plurality of modulator planes means comprises an electro-optic crystal having first and second major surfaces lying substantially transverse to said optical data beam.

9. The apparatus of claim 8 wherein said one-dimensional light modulation means of said at least first and second spatial light modulator planes and said two-dimensional light modulation means of said at least one spatial light modulator plane each compromise a plurality of patterned electrodes overlying said first major surface of a respective one of said crystals.

10. The apparatus of claim 9 wherein said light modulation means of said at least first and second spatial light modulator planes is further characterized as a pattern of parallel strip electrodes.

11. The apparatus of claim 10 wherein said light modulation means of said at least one additional spatial light modulator planes is further characterized as a matrix array of electrodes.

12. An optical processor system for processing data provided in an optical beam, said system comprising:

(a) means for providing an optical beam;

(b) at least three spatial light modulator planes;

(c) means for receiving said optical beam;

(d) means for interconnecting said at least three spatial light modulator planes such that said optical beam passes through said plurality of modulator planes; and (e) means for controlling and providing data selectively to said at least three modulator planes so as to provide for the programmable transfer of data to said optical beam.

13. The system of claim 12 wherein said interconnecting means includes lensless means for the focusless transfer of said optical beam between each one of said at least three spatial light modulator planes.

14. The system of claim 13 wherein said interconnecting means interconnects said beam providing means and said beam receiving means with respective ones of said at least three spatial light modulator planes such that said optical beam is focuslessly transferred thereinbetween.

15. The system of claim 14 wherein said at least three of spatial light modulator planes includes a one-dimensional spatial light modulator plane.

16. The system of claim 15 wherein said at least three spatial light modulator planes includes first and second one-dimensional spatial light modulator planes oriented mutually orthogonal with respect to one another and said optical beam.

17. The system of claim 16 wherein said at least three spatial light modulator planes includes one and two-dimensional spatial light modulator planes.

18. The system of claim 17 wherein said receiving means is further characterized as being coupled to a control processor for the transfer of data, from said receiving means to an output, in response to a signal from said control processor.

19. The system of claim 18 wherein said interconnecting means comprises:

(a) a fiber optic plate providing structural support for at least one modulator plane of said at least three modulator planes; and (b) an optical beam polarizer, interposed between said at least one modulator plane and said fiber optic plate.

20. The system of claim 19 wherein said beam providing means provides incoherent light.

21. The system of claim 20 wherein said beam providing means is further characterized as a source selected from the group consisting of flat electroluminescent sources, light emitting diode (LED) sources, plasma sources and partially coherent LED laser sources.

22. An optical computer for performing calculations on data by processing an optical data beam, said computer comprising:

(a) flat panel means for providing said optical data beam;

(b) a plurality of spatial light modulator planes selected from the group consisting of one-dimensional, two-dimensional pixel array linear matrix multiplier and systolic array spatial light modulators;

(c) accumulator means for receiving and acting upon said optical data beam by accumulating and shifting; and (d) interconnecting means for the lensless coupling of said flat panel means, said plurality of spatial light modulator planes, and said accumulator means so as to provide for the focusless transfer of said optical data beam from said flat panel means to said accumulator means through said plurality of spatial light modulator planes.

23. The optical computer of claim 22 wherein said interconnecting means comprises:

(a) a plurality of fiber optic plates for the rigid support of said plurality of spatial light modulator planes; and (b) a plurality of polarizing plates, said flat panel means being further characterized as providing a uniform incoherent optical beam.

24. The optical computer of claim 23 further comprising:

(a) a control processor;

(b) electrode means for respectively controlling said plurality of spatial light modulator planes for the transfer of data to said optical data beam;

(c) a plurality of buffer means coupled with said electrode means and said control processor for the mutual exchange of data therewith; and (d) means for transferring data from said accumulator means to said control processor.

* * * * *